US007801725B2

(12) United States Patent
Chen et al.

(10) Patent No.: US 7,801,725 B2
(45) Date of Patent: Sep. 21, 2010

(54) METHOD FOR SPEECH QUALITY DEGRADATION ESTIMATION AND METHOD FOR DEGRADATION MEASURES CALCULATION AND APPARATUSES THEREOF

(75) Inventors: Shi-Han Chen, Taipei (TW); Chih-Chung Kuo, Hsinchu (TW); Shun-Ju Chen, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 891 days.

(21) Appl. No.: 11/427,777

(22) Filed: Jun. 29, 2006

(65) Prior Publication Data

US 2007/0233469 A1 Oct. 4, 2007

(30) Foreign Application Priority Data

Mar. 30, 2006 (TW) ..... 95111137 A

(51) Int. Cl.
*G10L 11/04* (2006.01)
*G10L 13/06* (2006.01)

(52) U.S. Cl. ..... 704/207; 704/220; 704/258; 704/268

(58) Field of Classification Search ..... None
See application file for complete search history.

(56) References Cited

U.S. PATENT DOCUMENTS 5,664,050 A 9/1997 Lyberg
5,806,028 A 9/1998 Lyberg
6,980,955 B2 * 12/2005 Okutani et al. ..... 704/258
7,164,771 B1 * 1/2007 Treurniet et al. ..... 381/56
7,315,813 B2 * 1/2008 Kuo et al. ..... 704/207
2004/0024600 A1 * 2/2004 Hamza et al. ..... 704/268
2007/0203694 A1 * 8/2007 Chan et al. ..... 704/200.1
2007/0219790 A1 * 9/2007 Verhelst ..... 704/220

OTHER PUBLICATIONS

Murphy, T. et al. "Enhanced Non-Intrusive Objective Speech Quality Measure for Telephony Systems," ISSC 2005, Dublin, Sep. 1.*
Klabbers et al. 8th European Conference on Speech Communication and Technology (Eurospeech 2003—Interspeech 2003), Sep. 1-4, 2003, pp. 317-320, Geneva, Switzerland.

* cited by examiner

*Primary Examiner*—Matthew J Sked
(74) *Attorney, Agent, or Firm*—Jianq Chyun IP Office

(57) ABSTRACT

A method for speech quality degradation estimation, a method for degradation measures calculation, and the apparatuses thereof are provided. The first method above estimates the speech quality of a speech signal that is modified by a pitch-synchronous prosody modification method, which comprises the following steps. First, extract at least one source pitchmark from the speech signal, and then maps the source pitchmark(s) to at least one target pitchmark(s). Finally, calculate at least one degradation measure based on the mapping between the source and the target pitchmarks. The degradation measures include several weighted pitch-related functions and duration-related functions, where the weighting functions can be calculated based on the speech signal or the pitchmark(s) mapping mentioned above.

16 Claims, 5 Drawing Sheets

METHOD FOR SPEECH QUALITY DEGRADATION ESTIMATION AND METHOD FOR DEGRADATION MEASURES CALCULATION AND APPARATUSES THEREOF

CROSS-REFERENCE TO RELATED APPLICATION

This application claims the priority benefit of Taiwan application serial no. 95111137, filed on Mar. 30, 2006. All disclosure of the Taiwan application is incorporated herein by reference.

BACKGROUND OF THE INVENTION

1. Field of Invention

The present invention relates to a method for speech quality degradation estimation and a method for degradation measures calculation and apparatuses thereof. More particularly, the present invention relates to a method for speech quality degradation estimation applied to pitch-synchronous prosody modification and a method for degradation measures calculation and apparatuses thereof.

2. Description of Related Art

Text to speech synthesis technology has been developed for a long time and one of the most important factors for making speech sound natural is that the system must be able to synthesize speech with rich prosody. Presently, the major technology for modifying speech prosody is Time Domain Pitch Synchronous Overlap-and-Add (TD-PSOLA) technology. TD-PSOLA can modify the original prosody of speech, for example, modifying the first tone of Chinese to the fourth tone, and can produce synthesized speech of very good quality when degree of modification is limited within some range. However, if prosody of the source speech is very different from target prosody, TD-PSOLA may reduce the quality of the synthesized speech. In conventional technology, this problem is usually resolved by restricting the prosody modification to be within a fixed acceptable range, but there is no method to automatically predict the quality of the synthesized speech based on the source speech and the target prosody. Here, if a speech quality prediction mechanism can be added to estimate the synthesized speech quality, then the prosodies of different speech units can be modified appropriately within their tolerable speech quality ranges so that synthesized speech of high quality and high fidelity can be produced.

From another point of view, the existing major text to speech synthesis technology is corpus-based speech synthesis, wherein suitable speech units are chosen from a previously gathered speech database based on the target speech and these speech units are concatenated to synthesize speech of high quality. To synthesize high quality speech, the database should be large enough to contain all kinds of tones and prosodies such as excitement, sadness, calmness etc; thus, the required memory space is very large. Here, if suitable speech units are properly chosen from the large corpus and a speech quality estimation mechanism is added for determining which target speech unit can be synthesized by modifying another speech unit with a prosody modification method, then this target speech unit can be deleted from the original corpus. Because the speech quality of these synthesized target speech units can be restricted to be within an acceptable range through a speech quality estimation mechanism, the corpus size can be reduced without quality degradation.

Thus, a method of estimating prosody-modified speech is required, and to be applied broadly, this method has to be objective and automatic, that is, no human intervention is required during prediction or estimation. In order to be applied to real-time text to speech synthesis, this method preferably needs not to synthesize the target speech for predicting speech quality. However, all the existing technologies are not satisfying. First, in current text to speech synthesis field, there is no objective method for estimating the speech quality of a speech unit which is modified by a prosody modification method, only the continuities at concatenation points of speech units can be estimated. As to speech coding and transmission field, neither the Perceptual Speech Quality Measure (PSQM) nor the Perceptual Evaluation of Speech Quality (PESQ) suggested by the International Telecommunication Union (ITU) is suitable for estimating the quality of a speech which is modified by a prosody modification method, because both methods estimate the differences between spectra, but the spectrum of the modified speech is always changed regardless the quality of the synthesized speech.

U.S. Pat. No. 5,664,050 discloses a speech quality degradation estimation method. According to this method, first, a speech recognition system is set up and a test utterance produced by a speaker is input into the speech recognition system to obtain a reference score, then the synthesized speech is input into the system to obtain another score, the closer the two scores are, the better the quality of the synthesized speech is. The disadvantage of this method is that the target speech waveform has to be synthesized, and there is also a problem with the speech quality estimation standard thereof because scores from recognition models may not correspond to speech quality, synthesized speech of low score only means that the acoustic distance between the model and the synthesized speech is larger, but may not mean that the speech quality is not good.

The latest conventional technology disclosed is from a paper of E. Klabbers and J. P. H. van Santen, Center of Spoken Language Understanding, OGI, Eurospeech'03 (hereinafter "OGI"). The steps in the paper include: first, calculating the objective quality measures based on the distance between the pitch contours of the source speech and the target speech, and then inputting the objective quality measures into the regression model for calculating the objective speech quality scores. According to this method, even though objective estimation can be done without speech synthesis, however, how the prosody modification method performs prosody modification on the speech waveform is not considered, and only a fixed length of pitch sequence is respectively interpolated on the pitch contour of the source speech and the target speech for point to point distance calculation, thus, the objective speech quality scores thereof still cannot be used for accurately predicting the speech quality.

SUMMARY OF THE INVENTION

Accordingly, the present invention is directed to provide a method for speech quality degradation estimation which can be used for estimating the speech quality of a speech signal that is modified by a pitch-synchronous prosody modification method such as TD-PSOLA, wherein target speech does not required to be synthesized and no human intervention is required in the process. The estimated speech quality provided by the method is objective and is more accurate compared to the conventional method.

According to another aspect of the present invention, a method for degradation measures calculation is provided and which is a part of the foregoing speech quality degradation estimation method so it has the same purpose and advantages.

According to yet another aspect of the present invention, an apparatus for speech quality degradation estimation is provided for performing the aforementioned speech quality degradation estimation, and the speech quality degradation estimation apparatus has the same purpose and advantages as the speech quality degradation estimation method.

According to yet another aspect of the present invention, an apparatus for degradation measures calculation is provided for performing the aforementioned degradation measures calculation, and the degradation measures calculation apparatus has the same purpose and advantages as the degradation measures calculation method.

To achieve the aforementioned and other objectives, the present invention provides a speech quality degradation estimation method for estimating the speech quality of a speech signal that is modified by a pitch-synchronous prosody modification method, and the speech quality degradation estimation method includes the following steps. First, at least one source pitchmark is extracted from the speech signal, and then the source pitchmark is mapped to at least one target pitchmark. Next, at least one degradation measure is calculated based on the mapping between the source and the target pitchmarks.

According to the speech quality degradation estimation method described above, in an embodiment, the step of calculating the degradation measures further includes the following steps. First, at least one weighting function is calculated based on the speech signal itself or the mapping between the source pitchmark and the target pitchmark, then at least one pitch-related degradation measure is calculated based on the foregoing mapping and weighting function, and finally at least one duration-related degradation measure is calculated based on the foregoing mapping.

According to the speech quality degradation estimation method described above, it is further included in an embodiment that an objective speech quality score is calculated based on the foregoing degradation measure. The objective speech quality score may be calculated by using regression model or probabilistic model.

According to another aspect of the present invention, a degradation measures calculation method is further provided, which includes the following steps. First, at least one source pitchmark is extracted from a speech signal, and then at least one degradation measure is calculated based on the mapping between the source pitchmark and at least one target pitchmark. The degradation measure includes a plurality of weighted pitch-related functions and a plurality of duration-related functions, wherein the weighting functions can be calculated based on the foregoing speech signal or pitchmark mapping. Wherein, the target pitchmark is the target for modifying the speech signal with a pitch-synchronous prosody modification method, and the speech quality of the modified speech signal is estimated based on the degradation measure.

According to yet another aspect of the present invention, a speech quality degradation estimation apparatus is further provided, which is used for estimating the speech quality of the speech signal that is modified by a pitch-synchronous prosody modification method, and the speech quality degradation estimation apparatus includes a pitchmark extracting unit, a pitchmark mapping unit, and a degradation measures calculating unit. Wherein, the pitchmark extracting unit extracts at least one source pitchmark from the speech signal, the pitchmark mapping unit maps the source pitchmark to at least one target pitchmarks, and the degradation measures calculating unit calculates at least one degradation measure based on the mapping between the source pitchmark and the target pitchmark.

According to yet another aspect of the present invention, a degradation measures calculation apparatus is further provided, which includes a pitchmark extracting unit and a degradation measures calculating unit. The pitchmark extracting unit extracts at least one source pitclmuark from a speech signal, and the degradation measures calculating unit calculates at least one degradation measure based on the mapping between the source pitchmark and at least one target pitchmark. The degradation measure includes a plurality of weighted pitch-related functions and a plurality of duration-related functions, wherein the weighting functions are calculated based on the speech signal itself and the foregoing pitchmark mapping. Wherein, the target pitchmark is the target for modifying the speech signal with a pitch-synchronous prosody modification method, and the speech quality of the modified speech signal is estimated based on the degradation measure.

According to an exemplary embodiment of the present invention, the objective speech quality scores can be calculated with only the mapping between the pitchmarks of the source speech and the target speech and is used for predicting the quality of the synthesized speech, thus, it is not necessary to synthesize the target speech. The pitch-synchronous prosody modification method is to modify the speech prosody pitch-synchronously, thus any modification to the waveform and any accompanied waveform distortion are also pitch-synchronous. The main difference between the present invention and OGI method is that the degradation measures are calculated pitch-synchronously in the present invention while this characteristic is ignored in OGI method and wherein a fixed length of sequence is always used for calculating degradation measures, thus, the actual speech quality degradation caused by pitch-synchronous prosody modification method can be calculated more accurately in the present invention. Besides, in the present invention, various degradation measures are calculated based on the mapping between pitchmarks, especially duration-related degradation measures which are absent in OGI method, the subsequent experimental results can prove that the prediction accuracy of the present invention is much higher than that of OGI technology. In addition, the speech quality prediction mechanism of the present invention can reduce the corpus size greatly and make high quality and low storage space speech synthesis system possible.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
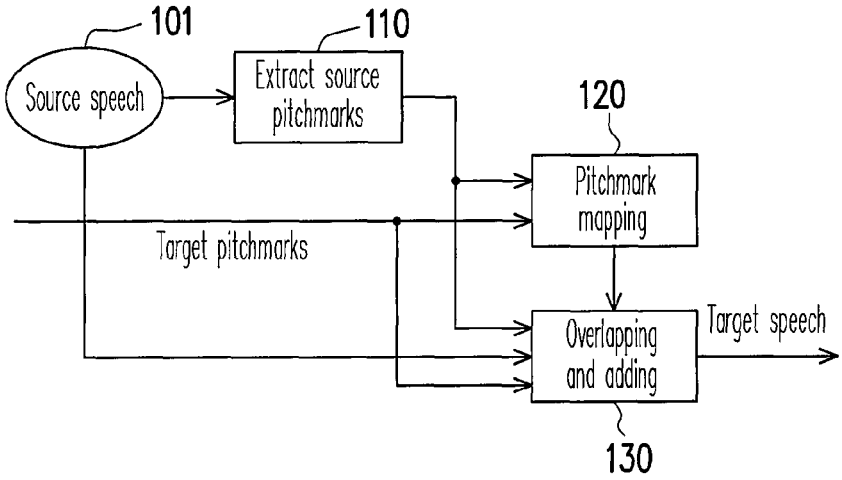
FIG. 1 (PRIOR ART)
FIG. 1 is a flowchart illustrating the typical TD-PSOLA.

The present invention can be applied to any pitch-synchronous prosody modification method, and TD-PSOLA is used as an example here for the convenience of description. First, TD-PSOLA will be described and the present invention is not limited to TD-PSOLA. FIG. 1 is a flowchart illustrating the typical PSOLA. First, source pitchmarks are extracted from the source speech 101 in step 110 and the source speech 101 is divided into a sequence of overlapping short-term signals (ST-signals) based on the source pitchmarks and an analysis window. Then, in step 120, the source pitchmarks are mapped to target pitchmarks. Finally, in step 130, the target speech is synthesized by overlapping and adding the ST-signals of the source speech 101 based on the aforementioned mapping.

Figure 2:
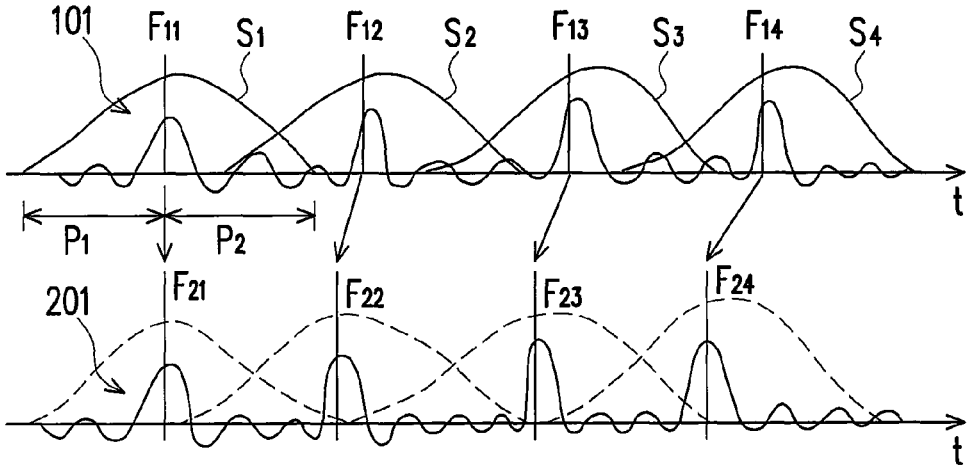
FIG. 2 (PRIOR ART)
FIG. 2 and FIG. 3 are diagrams illustrating pitchmarks at TD-PSOLA prosody modification.
Figure 3:
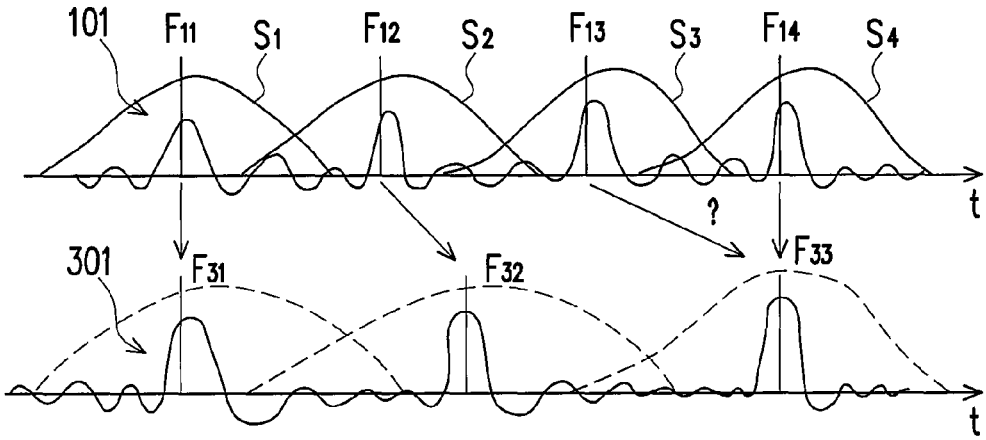
FIG. 3 (PRIOR ART)

FIG. 2 and FIG. 3 are diagrams illustrating pitchmark mappings of TD-PSOLA prosody modification. Referring to FIG. 2, first, $F_{11}$~$F_{14}$ are the source pitchmarks extracted from the source speech 101, the source speech 101 are divided into four ST-signals $S_1$~$S_4$, and $F_{21}$~$F_{24}$ are the target pitchmarks, i.e. the modification target of TD-PSOLA. The pitchmark mapping in FIG. 2 is very simple, which is a one-by-one mapping between $F_{11}$~$F_{14}$ and $F_{21}$~$F_{24}$, and then the source speech ST-signals $S_1$~$S_4$ are overlapped and added based on the locations of the target pitchmarks $F_{21}$~$F_{24}$ to synthesize the target speech 201.

The example in FIG. 3 is more complicated. In order to synthesize the target speech 301, how to map the four source pitchmarks $F_{11}$~$F_{14}$ to the three target pitchmarks $F_{31}$~$F_{33}$ has to be considered. For example, the target pitchmark $F_{33}$ has two possibilities, which can be mapped from the source speech ST-signals $S_3$ or $S_4$. The pitchmark mapping of TD-PSOLA is to deal with such problems.

Figure 4:
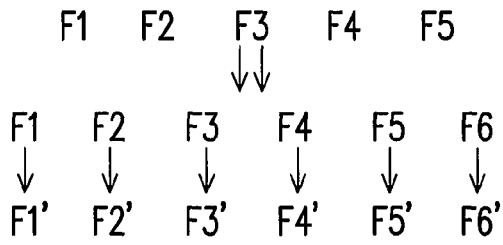
FIG. 4 (PRIOR ART)
FIG. 4 is a diagram illustrating pitchmark mapping in conventional technology.
Figure 5:
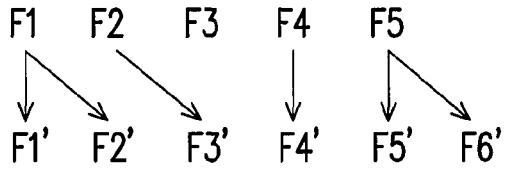
FIG. 5 is a diagram illustrating TD-PSOLA pitchmark mapping according to an embodiment of the present invention.

In both the present invention and the conventional OGI method, the degradation measures are first calculated and then the measures are inputted into the regression model to calculate the objective speech quality scores. However, the two degradation measures calculation methods are very different. The OGI degradation measures calculation method is illustrated in FIG. 4. In the example of FIG. 4, the pitch contour of the source speech has five pitch values F1~F5, and the pitch contour of the target speech has six pitch values F1'~F6' due to the longer duration thereof. According to OGI method, the five pitch values F1~F5 of the source speech are expanded to six, that is, F1~F6, through interpolation, and then F1~F6 are mapped to F1'~F6' one-by-one to calculate the distance measures. It is not considered in this method that TD-PSOLA prosody modification is pitch-synchronous modification, that is, each pitchmark of the target speech is mapped from a particular source pitchmark, and each target pitchmark waveform is produced by overlapping and adding the corresponding source speech ST-signals, accordingly, each the waveform distortion of each target ST-signal is directly related to the corresponding source speech ST-signal. Refer to FIG. 5 for the degradation measures calculation method in the present invention. Assuming that there are five source pitchmarks F1~F5 and six target pitchmarks F1'~F6'. According to the present invention, F1~F5 are mapped to F1'~F6' through TD-PSOLA mapping method, and then various degradation measures are calculated based on such mappings. In OGI method, a fixed length of pitch sequence is always interpolated on the pitch contours of the source speech and the target speech for calculating degradation measures, and the calculation is not related to the characteristic of prosodic modification algorithms. In the present invention, degradation measures are calculated by using TD-PSOLA pitchmark mapping, which, compared to the OGI method, can manifest more clearly the speech distortion caused by pitch-synchronous prosody modification method. The following experimental results can prove that the objective speech quality scores of the present invention are more accurate than that in the OGI method.

Figure 6:
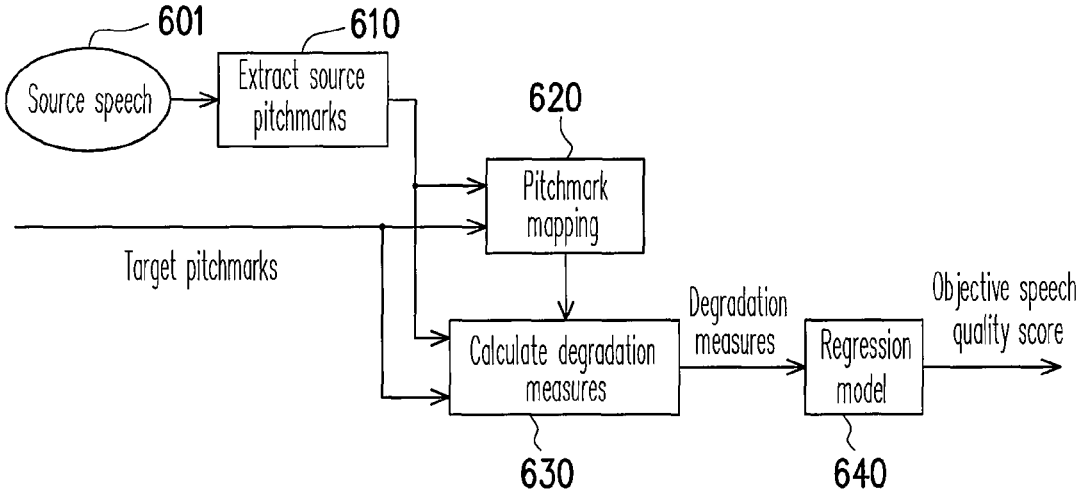
FIG. 6 and FIG. 7 are flowcharts illustrating the method for speech quality degradation estimation according to an embodiment of the present invention.

FIG. 6 is a flowchart illustrating the method for speech quality degradation estimation according to an embodiment of the present invention. The speech quality degradation estimation method can be used for estimating the speech quality of a speech signal that is modified through any pitch-synchronous prosody modification such as TD-PSOLA or harmonic noise model (HNM) method. First, in step 610, at least one source pitchmark is extracted from the speech signal 601, and then in step 620, the source pitchmark is mapped to at least one target pitchmark. Both steps 610 and 620 are to be performed in any pitch-synchronous prosody modification method (such as the steps 110 and 120 in FIG. 1), so the details thereof will not be described here again. Next, in step 630, at least one degradation measure is calculated based on the mapping between the source pitchmark and the target pitchmark. Finally, in step 640, the objective speech quality score is calculated based on the degradation measure by using regression model.

The function of step 640 is to map the objective degradation measure produced in step 630 onto the one dimensional axis that represents subjective speech quality, and the objective speech quality score represents the predicted value of the subjective speech quality. Besides regression model, other method, such as probabilistic model, may also be used in step 640 for calculating the objective speech quality scores.

Figure 7:
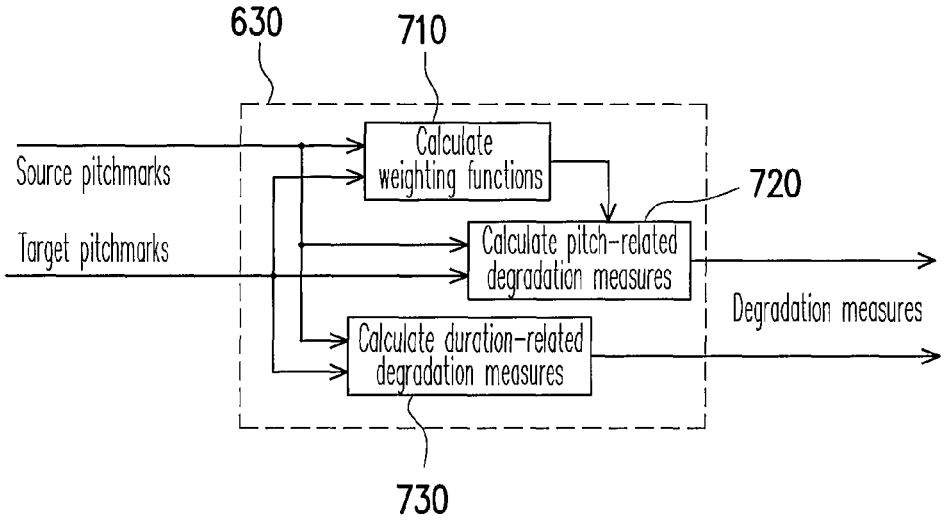

Presently, prosody modification is mainly regarding the pitch and the duration of a speech signal, thus in the present embodiment, the degradation measures are divided into pitch-related degradation measures and duration-related degradation measures. Step 630 in FIG. 6 can be further divided into three steps as shown in FIG. 7. First, in step 710, at least one weighting function is calculated based on the speech signal itself or the mapping between the source pitchmark and the target pitchmark. Then, in step 720, at least one pitch-related degradation measure is calculated based on the foregoing mapping and the weighting function. Finally, in step 730, at least one duration-related degradation measure is calculated based on the foregoing mapping.

The pitch-related degradation measures in the present embodiment include:

$$\left\{\frac{1}{N}\sum_{i=1}^{N}[w(i)\times abs(F_{0s}(ms_i)-F_{ot}(i))]^p\right\}^{1/p},$$

$$\left\{\frac{1}{N}\sum_{i=1}^{N}[w(i)\times abs(1-F_{ot}(i)/F_{0s}(ms_i))]^p\right\}^{1/p},$$

$$\left\{\frac{1}{N}\sum_{i=1}^{N}[w(i)\times abs(\Delta F_{0s}(ms_i)-\Delta F_{ot}(i))]^p\right\}^{1/p},$$

$$\max_i[w(i)\times abs(F_{0s}(ms_i)-F_{ot}(i))],$$

$$\max_i[w(i)\times abs(1-F_{ot}(i)/F_{os}(ms_i))],\text{ and}$$

$$\max_i[w(i)\times abs(\Delta F_{0s}(ms_i)-\Delta F_{ot}(i))],$$

the variations of the foregoing mathematical functions, for example, other mathematical functions calculated from the foregoing degradation measures function. Wherein, N is the number of the target pitchmarks, w(i) is one of the weighting functions in step 710, abs( ) is absolute value function, max( ) is maximum value function, $F_{0t}(i)$ is the logarithmic pitch of the $i^{th}$ target pitchmark, $F_{0s}(ms_i)$ is the logarithmic pitch of the $ms_i^{th}$ source pitchmark mapped to the $i^{th}$ target pitchmark, p is a default positive integer, and Δ represents slope.

In the present embodiment, there are four weighting functions. The first is constant 1, that is, no weighting function is set. The second is $f(F_{0s}(ms_i)-F_{0t}(i))$, wherein $F_{0t}(i)$ is the logarithmic pitch of the $i^{th}$ target pitchmark, $F_{0s}(ms_i)$ is the logarithmic pitch of the $ms_i^{th}$ source pitchmark mapped to the $i^{th}$ target pitchmark, f( ) is a default function. The function f( ) is to designate different weightings for upward and downward modification of the pitch because the speech quality degradation of downward modification is usually greater than that of upward modification, thus, in the present embodiment, function f( ) designates a greater weighting to the modification for reducing the pitch, that is, $f(S_1-T_1)>f(S_2-T_2)$ if the logarithmic pitch $S_1$ of the source pitchmark is greater than the logarithmic pitch $T_1$ of the target pitchmark and the logarithmic pitch $S_2$ of the source pitchmark is smaller than the logarithmic pitch $T_2$ of the target pitchmark.

The third weighting function is $\exp(\alpha\times\Delta F_{0s}(ms_i))$, wherein exp( ) is an exponential function, α is a default parameter, and Δ represents slope. The weighting function can enhance the speech quality distortion of the area wherein the pitch contour has larger variation in the source speech signal. The fourth weighting function is $$\sum_{t=-P_1}^{t=P_2} s(ms_i-n_i+t)^2,$$

wherein $P_1$ and $P_2$ are both default parameters, and $n_i$ is the time offset of the $ms_i^{th}$ source pitchmark, i.e. the distance to the time origin. Function $s(ms_i-n_i+t)$ is the speech signal ST-signal corresponding to the source pitchmark $ms_i^{th}$, for example, $s(ms_i-n_i+t)$ is the speech signal ST-signal $S_1$ corresponding to the source pitchmark $F_{11}$ in FIG. 2, and $P_1$ and $P_2$ represent the ranges extended forward and backward from the source pitchmark $F_{11}$. This weighting function represents the energy of the original speech signal, that is, the lower energy portion, and the lower weighting function is assigned to speech quality degradation with lower energy.

The foregoing four weighting functions are not for limiting the present invention. In other embodiments, variations based on the foregoing weighting functions can be used, for example, other mathematical functions calculated based on the foregoing weighting functions.

In the present embodiment, the duration-related degradation measures include $abs(1-DUR_t|DUR_s)$, $$\left\{\frac{1}{N}\sum_{i=1}^{N}[\text{pm_discont}(i)]^p\right\}^{1/p},$$

and $$\max_i(\text{pm_discont}(i)),$$

or variations based on the foregoing mathematical functions, for example, other mathematical functions calculated by using the foregoing duration-related functions. Wherein, the $DUR_s$ and $DUR_t$ in the first degradation measure are respectively the durations of the speech signal before and after being modified. N in the second degradation measure is the number of target pitchmarks, p is a default positive integer, pm_discont(i) is a default continuity function. Function pm_discont (i) has different values based on whether the source pitchmarks mapped to the target pitchmarks are continuous. Assuming $\Delta ms_i=ms_i-ms_{i-1}$, at continuous mapping, for example, $F_1$ and $F_2$ in FIG. 5 are respectively mapped to $F_2'$ and $F_3'$, or $F_4$ and $F_5$ are respectively mapped to $F_4'$ and $F_5'$, here $\Delta ms_i=1$, so pm_discont(i) is defined as 0. At repeated mapping, for example, $F_5$ in FIG. 5 is repeatedly mapped to $F_5'$ and $F_6'$, here $\Delta ms_i=0$, then pm_discont(i) is defined as β and β is a default parameter. The last situation is discontinuous mapping, for example, $F_2$ and $F_4$ in FIG. 5 are respectively mapped to $F_3'$ and $F_4'$, $F_3$ in between is skipped, here pm_discont(i) is defined as $\gamma\times\Delta ms_i$, and γ is another default parameter. The degradation measure represents the discontinuity of the pitchmarks of the original source speech after being mapped.

As described above, in the present embodiment, there may be at most six pitch-related degradation measures along with four weighting functions so that there may be at most 24 pitch-related degradation measures. Along with 3 duration-related degradation measures, there will be 27 degradation measures in total.

Figure 8:
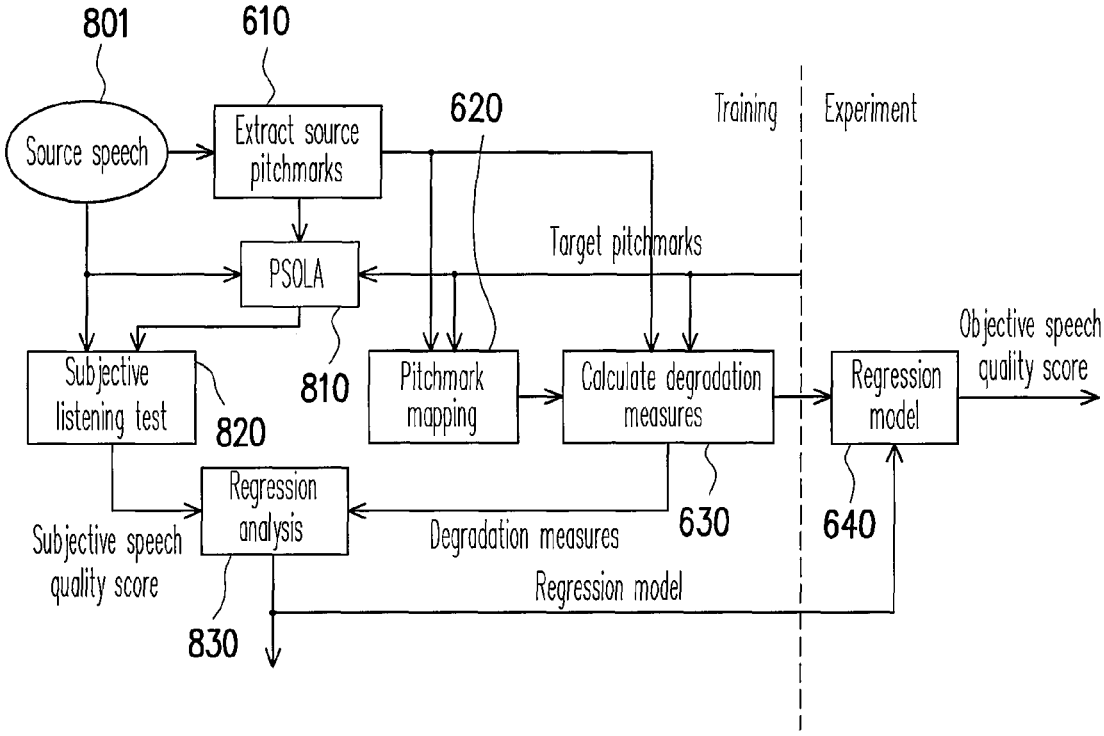
FIG. 8 is a flowchart illustrating the regression model training according to an embodiment of the present invention.

FIG. 8 is a flowchart illustrating the regression model training according to the present embodiment, wherein steps 610~640 are similar to the corresponding steps in FIG. 6 and which illustrate the flow of the speech quality degradation estimation method of the present embodiment. To train the regression model, first, in step 810, a target speech signal is synthesized with the source speech signal 801 and the target pitchmarks through TD-PSOLA, and then in step 820, subjects are asked to rate the synthesized speech signal to obtain the subjective speech quality scores. In step 830, regression analysis is performed using the subjective speech quality scores and the degradation measures calculated in step 630 to obtain the regression model, which is used for calculating the objective speech quality score in step 640.

The aforementioned regression analysis and regression model are both existing technologies so the details thereof will not be described here again. In short, the regression model adopted in step 640 is used for calculating objective speech quality scores based on the foregoing 27 degradation measures. The model is trained by minimizing errors between the objective speech quality scores and the subjective speech quality scores. The regression model can be a multiple linear regression model or support vector machine (SVM). The training of the regression model needs to be done only once during system development, and the completed model can be used repeatedly. Other models, such as probabilistic model, may also be used for the same purpose.

Next, the subjective listening test design in the present embodiment of the present invention will be described, wherein five Chinese vowels /a/, /i/, /u/, /ϵ/, /o/, each has 40 different speech units, are chosen. In each vowel, each speech unit may produce 39 prosody modification units by using prosodies of other speech units. 9 prosody modification units with even tone are chosen from the 39 prosody modification units and are combined with the original unmodified unit to form a testing group containing 10 units. Each vowel category may produce 360 prosody modification units, so that totally 1800 prosody modification units can be obtained from the five vowels. 16 subjects (9 males, 7 females) are asked to rate all the prosody modification units and 1800 subjective speech quality scores are obtained. The comparison category ration (CCR) defined by ITU is adopted in the listening test for determining the speech quality scores, and some improvements are done to make the obtained subjective speech quality scores more reliable. The subjects listen to two stimuli each time, and then the speech quality of the second stimulus compared to the first stimulus is determined with point −3~3. For each testing group, besides listening to the speech quality of the 9 prosody modified units compared to the original unit defined in CCR, all the 45 combinations in the testing group are all judged, so that the speech quality scores obtained eventually can be more reliable. Then the objective speech quality scores are calculated through OGI method and the speech quality degradation estimation method of the present embodiment and the subjective speech quality scores and the objective speech quality scores are compared. The results are listed below in Table 1.

TABLE 1

Experimental Results

| | Absolute error distribution percentage (%) | | | | | | | | Mean absolute |
|---|---|---|---|---|---|---|---|---|---|
| | <0.25 | <0.5 | <0.75 | <1.0 | <1.25 | <1.5 | <1.75 | R | error |
| OGI | 25.44 | 57.56 | 80.78 | 91.39 | 96.61 | 98.72 | 99.28 | 0.628 | 0.497 |
| OGI conversion formula | 41.33 | 74.89 | 88.50 | 92.94 | 95.67 | 97.72 | 99.00 | 0.737 | 0.392 |
| OGI conversion formula + pitch-synchronous | 47.17 | 80.28 | 92.94 | 97.67 | 99.06 | 99.28 | 99.61 | 0.840 | 0.328 |
| Linear model total | 59.28 | 87.00 | 97.28 | 99.22 | 99.83 | 99.94 | 100 | 0.906 | 0.251 |
| Linear model 4 | 58.50 | 85.67 | 95.94 | 99.22 | 99.67 | 99.89 | 100 | 0.890 | 0.264 |
| SVM total | 63.39 | 89.56 | 96.72 | 99.06 | 99.61 | 99.89 | 100 | 0.912 | 0.237 |
| SVM 4 | 63.33 | 88.67 | 97.11 | 99.11 | 99.89 | 100 | 100 | 0.909 | 0.241 |

The present experiment has 7 groups of results, each group of results has 9 fields, the first 7 fields, that is, from "<0.25" to "<1.75", are the distribution percentages of the absolute errors between the subjective speech quality scores and the objective speech quality scores. For example, in the 1800 errors of the original OGI method, those less than 0.25 account for 25.44% and those less than 0.5 account for 57.56% and so on. The $8^{th}$ field R is the Pearson's correlation between the subjective speech quality scores and the objective speech quality scores, and the $9^{th}$ field "mean absolute error" is the mean value of all 1800 absolute errors.

In the 7 groups of experimental results, the $1^{st}$ group is performed by the original OGI method, the $2^{nd}$ group "OGI conversion formula" is to replace the original OGI degradation measures calculation formula into by the pattern of degradation measures in the present embodiment, and the $3^{rd}$ group "OGI conversion formula+pitch-synchronous" is to replace the original OGI degradation measures calculation formula by the pattern of degradation measures in the present embodiment and to calculate the degradation measures pitch-synchronously, that is, based on the pitchmark mapping of the present invention. The $4^{th}$ to the $7^{th}$ groups are the methods of the present embodiment, wherein, "linear model total" uses multiple linear regression model and all the 27 degradation measures; "linear model 4" uses multiple linear regression model and 4 of the 27 degradation measures which can be combined to obtain the best (correlation coefficient/absolute error); "SVM total" uses SVM model and all 27 degradation measures; and "SVM 4" uses SVM model and 4 of the 27 degradation measures which can be combined to obtain the best (correlation coefficient/absolute error).

It can be understood from Table 1 that the method having the most inaccurate results is original OGI and the most accurate method is "SVM total" in the present invention. "OGI conversion formula" and "OGI conversion formula+pitch-synchronous" can both improve the performance of OGI method, which means the new pitch-synchronous and new degradation measures formula can certainly increase the prediction capability.

Figure 9:
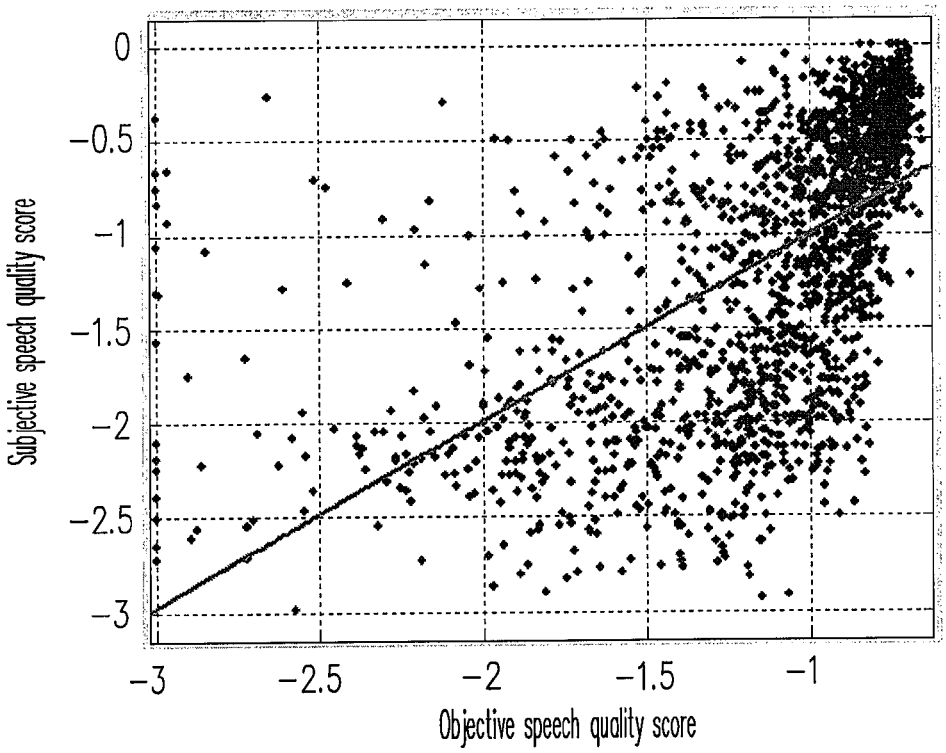
FIG. 9 (PRIOR ART)
FIG. 9 illustrates the experimental results in conventional technology.
Figure 10:
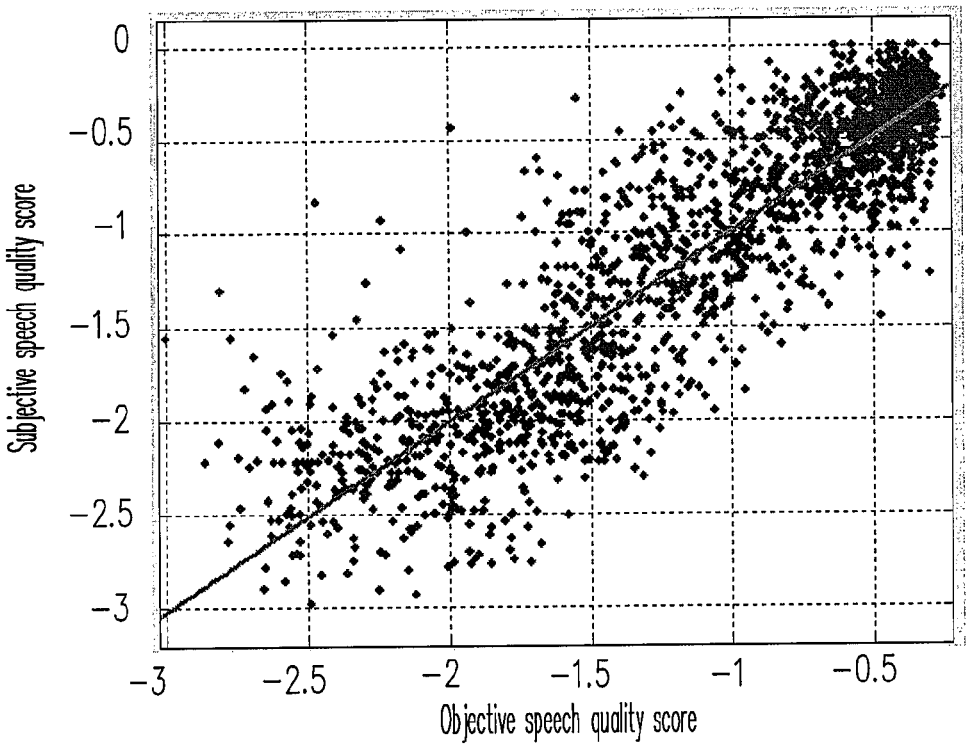
FIG. 10 illustrates the experimental results in an embodiment of the present invention.

FIG. 9 illustrates the correlation between the subjective speech quality scores and the objective speech quality scores obtained by the original OGI method in the present embodiment, and FIG. 10 illustrates the correlation between the subjective speech quality scores and the objective speech quality scores obtained by "linear model 4" in the present embodiment. It can be easily understood from Table 1, FIG. 9, and FIG. 10 that the speech quality degradation estimation method in the present invention is more accurate than OGI method since the correlation (R) of OGI method is only 0.628 while the relativity of the present invention is above 0.89.

In a speech synthesis system with a large corpus, some synthesis units in the corpus are selected with the speech quality degradation estimation method as source units, which can be used for producing other synthesis units through prosody modification mechanism in the future, and the prosodies of other units have to be produced through a prosody modification mechanism from these source units and the predicted synthesized speech qualities must be higher than a default tolerance value. By using the present invention, the original 16469 units can be reduced to 7935 if the differences between the objective speech quality scores after modification and the unmodified speech qualities is restricted to be lower than 0.21. If the differences are set to be lower than 0.25, the original 16469 units are reduced to 2704, which is only 16.4% of the original number.

Figure 11:
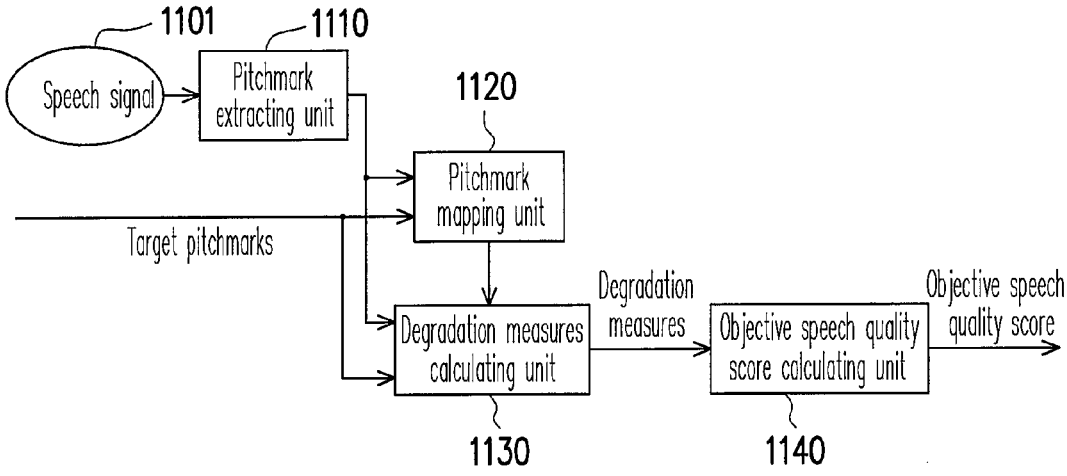
FIG. 11 is a block diagram of an apparatus for speech quality degradation estimation according to another embodiment of the present invention.

FIG. 11 is a block diagram of an apparatus for speech quality degradation estimation according to another embodiment of the present invention, and the speech quality degradation estimation apparatus is used for performing the speech quality degradation estimation method in the embodiment described above. The speech quality degradation estimation apparatus in FIG. 11 includes a pitchmark extracting unit 1110, a pitchmark mapping unit 1120, a degradation measures calculating unit 1130, and an objective speech quality score calculating unit 1140. The pitchmark extracting unit 1110 extracts at least one source pitchmark from the speech signal 1101 as illustrated in step 610 in FIG. 6. The pitchmark mapping unit 1120 maps the source pitchmark to at least one target pitchmark as illustrated in step 620 in FIG. 6. The degradation measures calculating unit 1130 calculates at least one degradation measure based on the mapping between the source pitchmark and the target pitchmark, as shown in step 630 in FIG. 6. The objective speech quality score calculating unit 1140 calculates the objective speech quality score based on the foregoing degradation measures as illustrated in step 640 in FIG. 6.

Figure 12:
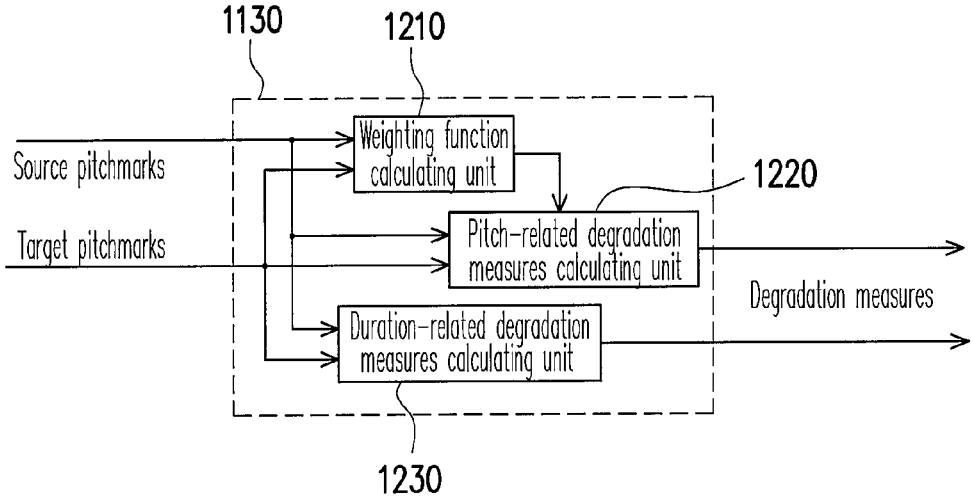
FIG. 12 is a block diagram of the degradation measures calculation unit in FIG. 11.

FIG. 12 is a block diagram of the degradation measures calculation unit 1130 in the present embodiment. The degradation measures calculating unit 1130 includes a weighting function calculating unit 1210, a pitch-related degradation measures calculating unit 1220, and a duration-related degradation measures calculating unit 1230. The weighting function calculating unit 1210 calculates at least one weighting function based on the speech signal itself or the mapping between the source pitchmark and the target pitchmark, as shown in step 710 in FIG. 7. The pitch-related degradation measures calculating unit 1220 calculates at least one pitch-related degradation measure based on the foregoing mapping and the weighting function, as shown in step 720 in FIG. 7. The duration-related degradation measures calculating unit 1230 calculates at least one duration-related degradation measure based on the foregoing mapping, as shown in step 730 in FIG. 7. The rest technology details have been described in the embodiments described above so the details will not be described here again.

In overview, in the present invention, the objective speech quality score can be calculated based on only the pitchmark mapping between source speech and target speech for predicting the synthesized speech quality, so that the target speech needs not to be synthesized. The major difference between the present invention and OGI method is that pitch-synchronous calculation is adopted for calculating degradation measures in the present invention while it is ignored in OGI method, wherein a fixed length of sequence is always interpolated for calculating degradation measures, thus, the actual speech quality degradation caused by pitch-synchronous prosody modification method can be calculated more accurately in the present invention. In addition, in the present invention, various degradation measures, especially duration-related degradation measures which are absent in OGI method, are calculated based on the mapping between pitchmarks. The experimental results prove that the prediction accuracy of the present invention is much more accurate than that of OGI technology. Moreover, based on the speech quality prediction mechanism of the present invention, the corpus size can be reduced greatly and high quality and low storage speech synthesis system is made possible.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speech quality degradation estimation method for estimating the speech quality of a speech signal modified by a pitch-synchronous prosody modification method, the speech quality degradation estimation method comprising:

extracting at least one source pitchmark from the speech signal;

mapping the source pitchmark to at least one target pitchmark; and calculating at least one degradation measure based on the mapping between the source pitchmark and the target pitchmark, wherein the degradation measure includes at least one of the following duration-related mathematical functions:

$$\mathrm{abs}(1 - DUR_t / DUR_s),\ \left\{\frac{1}{N}\sum_{i=1}^{N}[\mathrm{pm_discount}(i)]^p\right\}^{1/p},$$

$$\text{and } \max_i(\mathrm{pm_discont}(i)),$$

wherein abs( ) is absolute value function, max( ) is maximum value function, $DUR_s$ and $DUR_t$ are respectively the durations of the speech signal before and after being modified, N is the number of the jar pitchmarks, is a default positive integer, and pm_discont(i) is a default continuity function, which has different values based on whether the source pitchmarks mapped to the target pitchmarks are continuous.

2. The speech quality degradation estimation method as claimed in claim 1, wherein the step of calculating the degradation measures further comprises:

calculating at least one weighting function based on energy of the speech signal, direction of the pitch modification of the speech signal, or slope of a pitch contour of the speech signal; and calculating at least one pitch-related degradation measure based on the mapping between the source pitchmark and the target pitchmark and the weighting function.

3. The speech quality degradation estimation method as claimed in claim 2, wherein the pitch-related degradation measure includes at least one of the following mathematical functions:

$$\left\{\frac{1}{N}\sum_{i=1}^{N}[w(i)\times abs(F_{0s}(ms_i) - F_{ot}(i))]^p\right\}^{1/p},$$

$$\left\{\frac{1}{N}\sum_{i=1}^{N}[w(i)\times abs(1 - F_{ot}(i)/F_{0s}(ms_i))]^p\right\}^{1/p},$$

-continued $$\left\{\frac{1}{N}\sum_{i=1}^{N}[w(i)\times abs(\Delta F_{0s}(ms_i)-\Delta F_{ot}(i))]^p\right\}^{1/p},$$

$$\max_i[w(i)\times abs(F_{0s}(ms_i)-F_{ot}(i))],$$

$$\max_i[w(i)\times abs(1-F_{ot}(i)/F_{0s}(ms_i))],\quad \text{and}$$

$$\max_i[w(i)\times abs(\Delta F_{0s}(ms_i)-\Delta F_{ot}(i))],$$

wherein N is the number of the target pitchmarks, w(i) is one of the weighting functions, abs( ) is absolute value function, max( ) is maximum value function, $F_{0t}(i)$ is the logarithmic pitch of the $i^{th}$ target pitchmark, $F_{0s}(ms_i)$ is the logarithmic pitch of the $ms_i^{th}$ source pitchmark mapped to the $i^{th}$ target pitchmark, p is a default positive integer, and Δ represents slope.

4. The speech quality degradation estimation method as claimed in claim 3, wherein the weighting function w(i) includes at least one of the following mathematical functions: constant 1, $f(F_{0s}(ms_i)-F_{0t}(i))$, $\exp(\alpha\times\Delta F_{0s}(ms_i))$, and $$\sum_{t=-P_1}^{t=P_2} s(ms_i-n_i+t)^2,$$

wherein f( ) is a default function, exp( ) is exponential function, $F_{0t}(i)$ is the logarithmic pitch of the $i^{th}$ target pitchmark, $F_{0s}(ms_i)$ is the logarithmic pitch of the $ms_i^{th}$ source pitchmark mapped to the $i^{th}$ target pitchmark, α, $P_1$, and $P_2$ are default parameters, Δ represents slope, $n_i$ is the time offset of the $ms_i^{th}$ source pitchmark, and $s(ms_i-n_i+t)$, $P_1<=t<=P_2$ is the ST-signal of the speech signal corresponding to the $ms_i^{th}$ source pitchmark.

5. The speech quality degradation estimation method as claimed in claim 4, wherein $f(S_1-T_1)>f(S_2-T_2)$ if $S_1>T_1$ and $S_2<T_2$, $S_1$ is a logarithmic pitch value of one of the source pitchmarks, $S_2$ is a logarithmic pitch value of another one of the source pitchmarks, $T_1$ is a logarithmic pitch value of the target pitchmark mapped from the source pitchmark of $S_1$, $T_2$ is a logarithmic pitch value of the target pitchmark mapped from the source pitchmark of $S_2$.

6. The speech quality degradation estimation method as claimed in claim 1, wherein pm_discont(i)=0 if $\Delta ms_i=1$, and pm_discont(i)=β if $\Delta ms_i=0$, otherwise pm_discont(i)=$\gamma\times\Delta ms_i$, wherein $\Delta ms_i=ms_i-ms_{i-1}$, the $ms_i^{th}$ source pitchmark is mapped to the $i^{th}$ target pitchmark, and the $ms_{i-1}^{th}$ source pitchmark is mapped to the $(i-1)^{th}$ target pitchmark, and β and γ are both default parameters.

7. A degradation measures calculation method, comprising:

extracting at least one source pitchmark from a speech signal; and calculating at least one degradation measure based on the mapping between the source pitchmark and at least one target pitchmark;

wherein the target pitchmark is the target for modifying the speech signal with a pitch-synchronous prosody modification method, the speech quality of the modified speech signal is estimated based on the degradation measure, and the degradation measure includes at least one of the following duration-related mathematical functions:

$$\text{abs}(1-DUR_t/DUR_s),\ \left\{\frac{1}{N}\sum_{i=1}^{N}[\text{pm_discont}(i)]^p\right\}^{1/p},$$

$$\text{and}\ \max_i(\text{pm_discont}(i)),$$

wherein abs( ) is absolute value function, max( ) is maximum value function, $DUR_s$ and $DUR_t$ are respectively the durations of the speech signal before and after being modified, N is the number of the target pitchmarks, p is a default positive integer, and pm_discont(i) is a default continuity function, which has different values based on whether the source pitchmarks mapped to the target pitchmarks are continuous.

8. The degradation measures calculation method as claimed in claim 7, wherein the step of calculating the degradation measure further comprises:

calculating at least one weighting function based on energy of the speech signal, direction of the pitch modification of the speech signal, or slope of a pitch contour of the speech signal; and calculating at least one pitch-related degradation measure based on the mapping between the source pitchmark and the target pitchmark and the weighting function.

9. The degradation measures calculation method as claimed in claim 8, wherein the pitch-related degradation measure includes at least one of the following mathematical functions:

$$\left\{\frac{1}{N}\sum_{i=1}^{N}[w(i)\times abs(F_{0s}(ms_i)-F_{ot}(i))]^p\right\}^{1/p},$$

$$\left\{\frac{1}{N}\sum_{i=1}^{N}[w(i)\times abs(1-F_{ot}(i)/F_{0s}(ms_i))]^p\right\}^{1/p},$$

$$\left\{\frac{1}{N}\sum_{i=1}^{N}[w(i)\times abs(\Delta F_{0s}(ms_i)-\Delta F_{ot}(i))]^p\right\}^{1/p},$$

$$\max_i[w(i)\times abs(F_{0s}(ms_i)-F_{ot}(i))],$$

$$\max_i[w(i)\times abs(1-F_{ot}(i)/F_{0s}(ms_i))],\quad \text{and}$$

$$\max_i[w(i)\times abs(\Delta F_{0s}(ms_i)-\Delta F_{ot}(i))],$$

wherein N is the number of the target pitchmarks, w(i) is one of the weighting functions, abs( ) is absolute value function, max( ) is maximum value function, $F_{0t}(i)$ is the logarithmic pitch of the $i^{th}$ target pitchmark, $F_{0s}(ms_i)$ is the logarithmic pitch of the $ms_i^{th}$ source pitchmark mapped to the $i^{th}$ target pitchmark, p is a default positive integer, and Δ represents slope.

10. The degradation measures calculation method as claimed in claim 9, wherein the weighting function w(i) includes at least one of the following mathematical functions: constant 1, $f(F_{0s}(ms_i)-F_{0t}(i))$, $\exp(\alpha\times\Delta F_{0s}(ms_i))$, and $$\sum_{t=-P_1}^{t=P_2} s(ms_i-n_i+t)^2,$$

wherein f( ) is a default function, exp( ) is an exponential function, $F_{0t}(i)$ is the logarithmic pitch of the $i^{th}$ target pitchmark, $F_{0s}(ms_i)$ is the logarithmic, pitch of the $ms_i^{th}$ source pitchmark mapped to the $i^{th}$ target pitchmark, $\alpha$, $P_1$, and $P_2$ are all default parameters, $\Delta$ represents slope, $n_i$ is the time offset of the $ms_i^{th}$ source pitchmark, and $s(ms_i-n_i+t)$, $P_1<=t<=P_2$ is the ST-signal of the speech signal corresponding to the $ms_i^{th}$ source pitchmark.

11. The degradation measures calculation method as claimed in claim 10, wherein $f(S_1-T_1)>f(S_2-T_2)$ if $S_1>T_1$ and $S_2<T_2$, $S_1$ is a logarithmic pitch value of one of the source pitchmarks, $S_2$ is a logarithmic pitch value of another one of the source pitchmarks, $T_1$ is a logarithmic pitch value of the target pitchmark mapped from the source pitchmark of $S_1$, $T_2$ is a logarithmic pitch value of the target pitchmark mapped from the source pitchmark of $S_2$.

12. The degradation measures calculation method as claimed in claim 7, wherein pm_discont(i)=0 if $\Delta ms_i=1$, pm_discont(i)=$\beta$ if $\Delta ms_i=0$, otherwise pm_discont(i)=$\gamma\times\Delta ms_i$, wherein $\Delta ms_i=ms_i-ms_{i-1}$, the $ms_i^{th}$ source pitchmark is mapped to the $i^{th}$ target pitchmark, and the $ms_{i-1}^{th}$ source pitchmark is mapped to the $(i-1)^{th}$ target pitchmark, $\beta$ and $\gamma$ are both default parameters.

13. A speech quality degradation estimation apparatus for estimating the speech quality of a speech signal modified by a pitch-synchronous prosody modification method, the speech quality degradation estimation apparatus comprising:

a pitchmark extracting unit, extracting at least one source pitchmark from the speech signal;

a pitchmark mapping unit, mapping the source pitchmark to at least one target pitchmark; and a degradation measures calculating unit, calculating at least one degradation measure based on the mapping between the source pitchmark and the target pitchmark wherein the degradation measures calculating unit calculates at least one duration-related degradation measure based on the mapping between the source pitchmark and the target pitchmark and the duration-related degradation measure includes at least one of the following mathematical functions:

$$\mathrm{abs}(1-DUR_t/DUR_s),\ \left\{\frac{1}{N}\sum_{i=1}^{N}[\mathrm{pm_discount}(i)]^p\right\}^{1/p},$$

$$\text{and } \max_i(\mathrm{pm_discont}(i)),$$

wherein abs( ) is absolute value function, max( ) is maximum value function, $DUR_s$ and $DUR_t$ are respectively the durations of the speech signal before and after being modified, N is the number of the target pitchmarks, p is a default positive integer and pm_discont(i) is a default continuity function, which has different values based on whether the source pitchmarks mapped to the target pitchmarks are continuous.

14. The speech quality degradation estimation apparatus as claimed in claim 13, wherein the degradation measures calculating unit comprises:

a weighting function calculating unit, calculating at least one weighting function based on energy of the speech signal, direction of the pitch modification of the speech signal, or slope of a pitch contour of the speech signal; and a pitch-related degradation measures calculating unit, calculating at least one pitch-related degradation measure based on the mapping between the source pitchmark and the target pitchmark and the weighting function.

15. A degradation measures calculation apparatus, comprising:

a pitchmark extracting unit, extracting at least one source pitchmark from a speech signal; and a degradation measures calculating unit, calculating at least one degradation measure based on the mapping between the source pitchmark and at least one target pitchmark;

wherein the target pitchmark is the target for modifying the speech signal with a pitch-synchronous prosody modification method, the speech quality of the modified speech signal is estimated based on the degradation measure, the degradation measures calculating unit calculates at least one duration-related degradation measure based on the mapping between the source pitchmark and the target pitchmark, and the duration-related degradation measure includes at least one of the following mathematical functions $$\mathrm{abs}(1-DUR_t/DUR_s),\ \left\{\frac{1}{N}\sum_{i=1}^{N}[\mathrm{pm_discount}(i)]^p\right\}^{1/p},$$

$$\text{and } \max_i(\mathrm{pm_discont}(i)),$$

wherein abs( ) is absolute value function, max( ) is maximum value function, $DUR_s$ and $DUR_t$ are respectively the durations of the speech signal before and after being modified, N is the number of the target pitchmarks, p is a default positive integer, and pm_discont(i) is a default continuity function, which has different values based on whether the source pitchmarks mapped to the target pitchmarks are continuous.

16. The degradation measures calculation apparatus as claimed in claim 15, wherein the degradation measures calculating unit comprises:

a weighting function calculating unit, calculating at least one weighting function based on energy of the speech signal, direction of the pitch modification of the speech signal, or slope of a pitch contour of the speech signal; and a pitch-related degradation measures calculating unit, calculating at least one pitch-related degradation measure based on the mapping between the source pitchmark and the target pitchmark and the weighting function.

* * * * *